United States Patent [19]

Secka et al.

[11] Patent Number: 5,003,444

[45] Date of Patent: Mar. 26, 1991

[54] MEANS FOR ALL-AROUND DISPLAY OF A FLAT IMAGE OVER AN ANGLE OF 360 DEGREES

[76] Inventors: Jan Secka, 31, High Street E. 203, Mississauga, Ontario L5G 1J9, Canada; Kurt F. Büchel; Paul Rosenich, both of Bergstrasse 297, FL-9495 Triesen, Liechtenstein

[21] Appl. No.: 388,964

[22] Filed: Aug. 2, 1989

[30] Foreign Application Priority Data

Aug. 2, 1988 [CH] Switzerland ..... 2915/88

[51] Int. Cl.[5] ..... F21P 5/04

[52] U.S. Cl. ..... 362/277; 362/35; 362/284

[58] Field of Search ..... 362/35, 277, 284, 812, 362/272; 40/431, 427; 352/109, 61

[56] References Cited

U.S. PATENT DOCUMENTS 2,913,954 11/1959 Morgan ..... 352/2

4,760,443 7/1988 Secka ..... 358/87

FOREIGN PATENT DOCUMENTS 143653 5/1985 United Kingdom .

*Primary Examiner*—Stephen F. Husar

*Assistant Examiner*—Sue Hagarman

[57] ABSTRACT

Structure for the all-around display of a flat image over an angle of 360°. The image should be visible with a continuous luminous intensity, regardless of the rotary speed. According to the invention, the maximum variation of the luminous flux from the light source—as a function of the rotary speed—must not reach a degree which is detectable by the human visual apparatus. Advantage is taken of the sluggishness of the human visual apparatus if, during each complete revolution of the image carrier through 360°, the total time of all bright phases is at least 30%, preferably at least 50%, in particular at least 70%, of the time of a revolution of the image carrier, and/or if the frequency of the bright phases is at least 200 Hz, the bright phases preferably emitting at least 75%, in particular at least 90%, of the maximum luminous intensity.

31 Claims, 2 Drawing Sheets

FIG.1
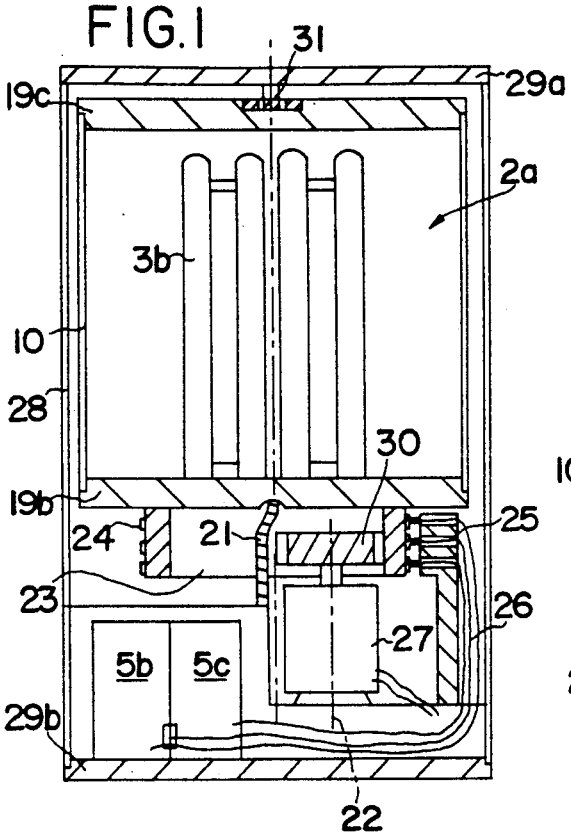
FIG.2
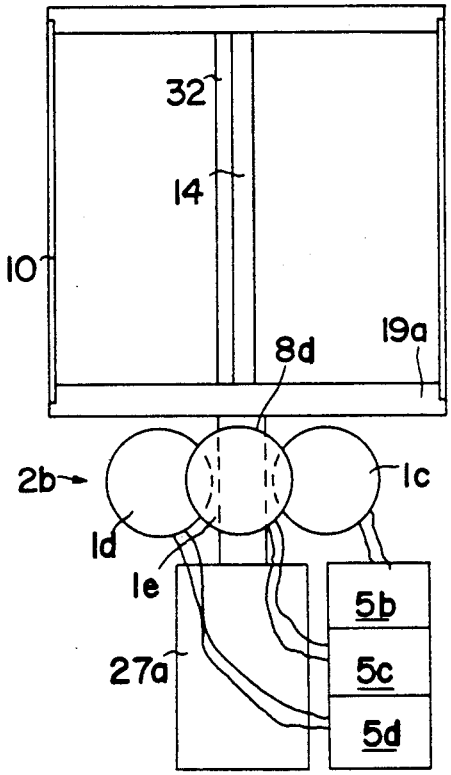
FIG.3
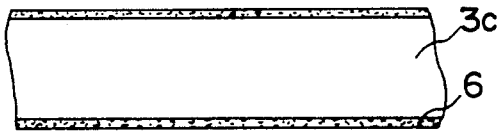
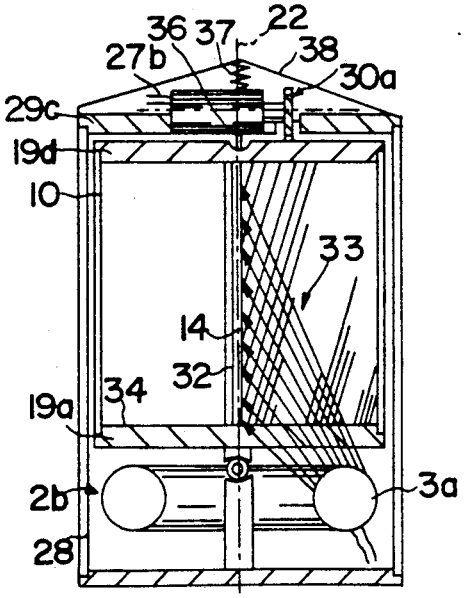
FIG.5
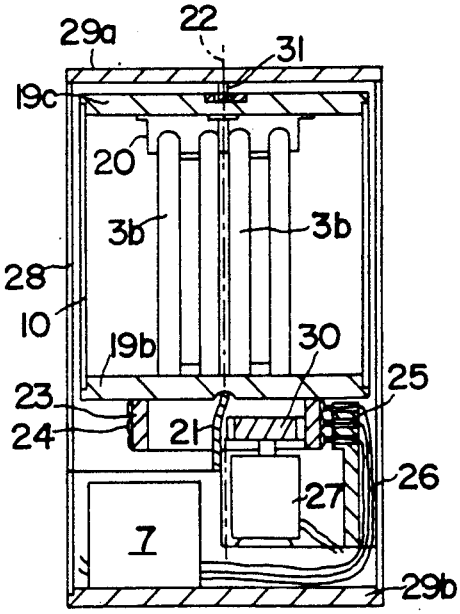
FIG.4

FIG.6
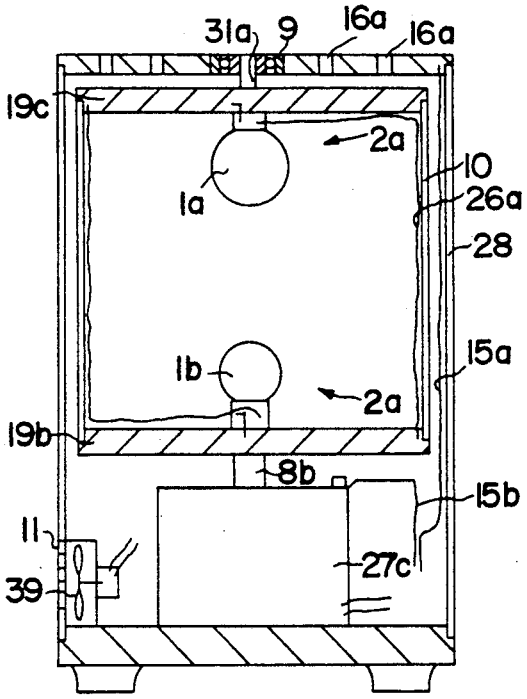
FIG.7
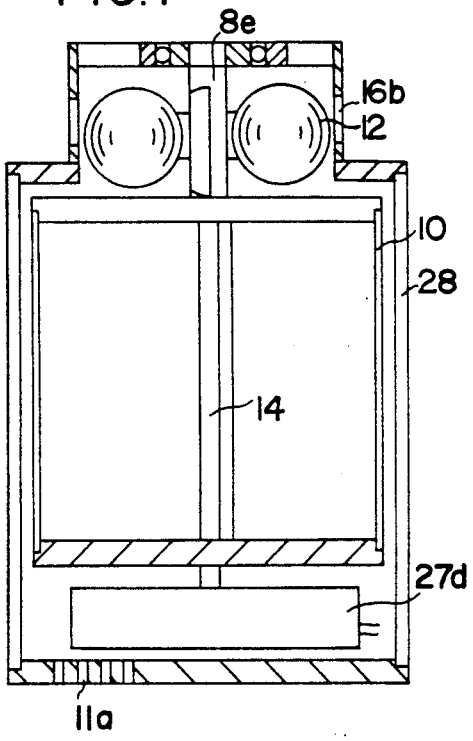
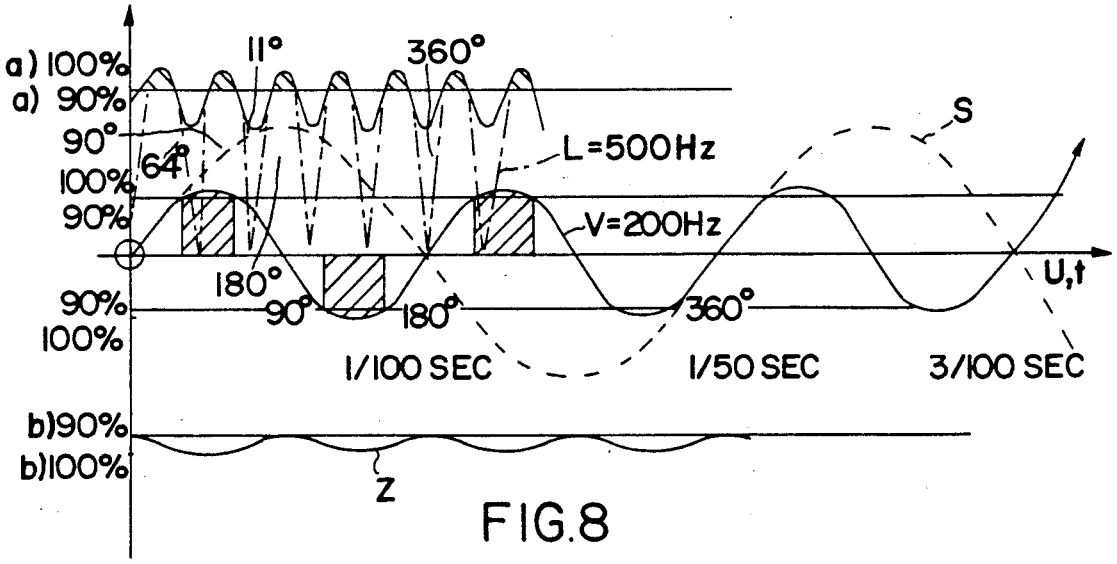
FIG.8

MEANS FOR ALL-AROUND DISPLAY OF A FLAT IMAGE OVER AN ANGLE OF 360 DEGREES

BACKGROUND OF THE INVENTION

1. Field of the Invention

The invention relates to a light source for a rotating indicator device, that is a means for all-around display of a picture. Such a means for all-around display is disclosed in EP-A-208283. This European Patent Application as well as PCT/CH88/00098 and the Patent Application "Rotatable means for the visualisation of an image over an angle of 360° " filed on the same day as the present Patent Application are considered to be disclosed for the purposes of this description.

2. Description of the Related Art

EP-A-208283 describes the principle of the means, while PCT/CH88/00098 indicates improvements and specifications of the grid. The Patent Application "Rotatable means for the visualisation of an image over an angle of 360°" is concerned with a specific embodiment of the drive system.

The few previously known means corresponding to the above mentioned publications function well, in view of the technical improvements already carried out and corresponding to the Patent Applications mentioned at the outset.

However, in realising the means according to the Patent Applications mentioned at the outset, a long-unexplained phenomenon was observed, this phenomenon being found troublesome by many users: the image visible all around exhibited wave-like fluctuations in its brightness and luminous intensity. Instability of the motor speed was thought to be a cause of this fluctuation. The Applicant then carried out various tests on the speed stability and found for the first time that the light fluctuations observed were due not—as assumed for a long time by the specialists—to instability of the motor speed but rather to interference phenomena of the previously used light sources or their light output fluctuating at the frequency of the mains alternating current, which light output having no recognisable importance in normal operation of such a light source outside the means according to the invention.

SUMMARY OF THE INVENTION

In view of the above said it is the object of the invention to develop or find a light source adapted to emit a luminous flux for a means for all-around display of a flat image over an angle of 360 degrees, which is such that the effects described as being disadvantageous do not occur when the said light source is used. This object is achieved for the first time by a light source having the following features.

a drive motor and an image carrier which is capable of being driven by said motor, said image carrier carries at least one image and can be rotated at a minimum rotary speed of 500 rpm, whereby the ratio of the bright phases of said luminous flux, with brightness exceeding 50% of the maximum luminous intensity, to the rotary speed is selected in such a way that any remaining fluctuation in brightness is undetectable by the human visual apparatus.

For the realization of a lamp according this general rule, different variants are possible, which are characterised by the following features:

During each complete revolution of the image carrier throught 360°, the total time of all bright phases amounts to at least 30%, preferably at least 50%, in particular at least 70%, of the time of a revolution of the image carrier, and/or that the frequency of the bright phases is at least 200 Hz, the bright phases emitting at least 75%, in particular at least 90%, of the maximum luminous intensity.

Each dark phase lasts no longer than 0.0025 second, and/or that the ratio of the bright phases to the rotary speed is selected in such a way that the time of visibility of the image from a given observation point corresponds to at least one bright phase, in particular more than two bright phases, and this ratio is expediently an integral ratio.

Each dark phase lasts no longer than 0.0025 second, and/or that the ratio of the bright phases to the rotary speed is selected in such a way that the time of visibility of the image from a given observation point corresponds to at least one bright phase, preferably at least two bright phases, in particular more than two bright phases, and this ratio is expediently an integral ratio.

The light source has at least one incandescent lamp which is adapted to be supplied with direct current or with an alternating current of at least 100 Hz.

The light source has a gas discharge lamp, in particular a low-pressure neon tube or a PL tube, an alternating current voltage of at least 300 Hz for example from an electronic ballast being provided as the supply voltage.

The alternating current voltage is of up to 40000 Hz.

The light source has a gas discharge lamp with a fluorescent layer for the afterglow, the afterglow time of the said layer with at least 90% of the maximum light intensity preferably being longer than 1/500 second.

The light source has a gas discharge lamp with a fluorescent layer for the afterglow, the afterglow time of the said layer with at least 90% of the maximum light intensity preferably being longer thant 1/500 second.

At least two lamps are provided, the said lamps being capable of being supplied with voltage phase-shifted by at least 120°.

Two lamps are provided and the voltage phase-shift is 180°.

The lamp is arranged concentrically around an axis of rotation of the image-carrying drum, outside the latter, and that an image carrier baseplate which faces the lamp is at least partially transparent for illumination of the image with reflected or transmitted light, the image carrier preferably being in the form of a transparent drum with an image mounted in the axis.

At least one lamp is mounted eccentrically in front of the image in a plate of rotatable, transparent drum which forms the image carrier, the said lamp being held in an opposite plate of the drum, and/or that the power supply for the lamp(s) is via a bearing shaft arranged at the top of the drum and one arranged at the bottom of the drum.

The voltage is supplied to the lamps via rotary bearings, the voltage being selected so that the required current does not exceed 1 Amp.

Forced ventilation is provided, which directly cools a lamp located outside the drum.

The image carrier is within a drum and that said drum is adapted to convey cool air from the lower region of the means upwards between a transparent outer housing and the drum.

Vents are provided in the top and cower regions of said drum.

A fan wheel is fastened to the drum.

However, it is a further object to have quantity of light emitted from the image with apparent optimal uniformity. This apparent uniformity is an optical deception; in fact, the image is conveyed (for example at 3000 revolutions) 50 times a second past the observer and releases a light flash 50 times a second to this observer; however, since the human visual apparatus is substantially more sluggish, these light flashes are perceived as a stationary image.

For the last mentioned object it is possible to have the dark phase of the light not longer than 0,0025 seconds. However, also the ratio of the bright phases to the rotary speed has to be considered. The percentage share of the bright phases becomes then less significant.

The simplest form of a corresponding light source is an incandescent lamp the wanted effect arises because the lamp filament has a certain post-illumination time—it is in fact caused to glow by the current. Although the lamp filament cools during the zero transition of a current or voltage wave, this process is associated with a time lag. The disadvantage is that the required amount of energy and the unintentionally released quantity of heat are relatively large. However, since the filaments are of different glowing quality tests have to be made to find the right lamp with the right filament. The use of a gas discharge lamp on an input frequency of more than 300 Hz preferably up to 40000 Hz reduces the power consumption and the evolution of heat while maintaining or increasing the light output, and the use of an electronic ballast in addition may prolong the bright phases and reduce the dark phases, or may prolong the time afterglow of the fluorescence coating.

When alternating current is used, rectifiers are indispensable, and the apparatuses can be used with mains supply.

A simple measure for achieving the effect according to the invention is based on the phase shift of the power supply of two lamps. The type of the lamps tending to be unimportant in that case—but the uniformity of the light is advantageous for light continuity, for example with the use of lamps with gas discharge or fluorescence after glow. By means of those measures, the total time of all bright phases is increased and their duration may be prolonged provided that addition of the luminous fluxes of the different lamps at a certain point gives a luminous flux of more than 90% of the maximum light intensity.

It is a further object of the invention to reduce the balancing problems of the rotating parts of the means to a minium. Moreover, the heat dissipation problems vanish since the lamp should be directly cooled.

However, even a variant with a rotating lamp should manage with less energy than the previously described variant while giving the same light output. In the case of incandescent lamps or metal vapour lamps, it would also be possible to mount several lamps in a drum (for example bottom and top) in order to obtain the desired luminous intensity. The closer the lamps are arranged to the axis of rotation of the drum, the smaller are the centrifugal forces acting on them. They can also be mounted directly at the axis of rotation, that is to say at the rear of the image, in which case it is expedient to have a reflector with heat-removing properties between the lamp and the image.

It is a further object to describe advantageous cooling variants for solving the temperature problem invariably present in the case of a motor drive and electrical lights.

BRIEF DESCRIPTION OF THE DRAWINGS

The invention is described in detail, by way of example and with reference to drawings. Further features, advantages and effects are to be found in the description of the Figures.

FIG. 1 shows a section through a means having PL neon lamps as a light source;

FIG. 2 shows a variant having lamps operated with a phase shift;

FIG. 3 shows a section through a special embodiment of a fluorescent lamp;

FIG. 4 shows a detail of a lampholder;

FIG. 5 shows a variant with an annular lamp outside the rotating drum;

FIG. 6 shows a variant with power supply via shafts;

FIG. 7 shows a section through a drum with a fan wheel, and

FIG. 8 shows various curves to explain the characteristics, according to the invention, of a light source.

DETAILED DESCRIPTION OF PREFERRED EMBODIMENTS

FIG. 8 shows a sine curve S in the form of a dashed line—beginning at the origin of the horizontal axis U, t, the said curve reproducing the rotation cycle of the image carrier or of the image over the time in relation to the angular position. At a rotary speed of 50 revolutions per second, the image thus covers an angle of 360° during a time of 1/50 seconds.

A solid sine wave V with twice the frequency compared with that of the rotation cycle is shown over the same horizontal axis U, t. It essentially represents a light cycle wave, or the voltage—an alternating voltage—supplied to the light source. The light maxima each occur close to (owing to internal inertia, generally slightly after) the voltage maxima in the positive (upper) or negative (lower) region of the horizontal axis. For the sake of simplicity, it is represented as if the voltage curve were identical to the light curve. According to the invention, the region to be defined as a bright phase is any region in which the luminous intensity is at least 50%, preferably at least 75%, in particular at least 90%, of the maximum luminous intensity. The shaded areas to the right thus indicate the bright phases over the time, with a light cycle of 200 Hz, which corresponds to a voltage cycle of 100 Hz (alternating current voltage). The bright phases amount altogether to about 30% of the total time of a revolution, this being sufficient to achieve the effect according to the invention.

However, a light source which follows a voltage curve indicated by the dash-dot line L, in which voltage or current pulses are released at a frequency of 500 Hz (corresponding to an alternating current of 250 Hz), is preferable; due to the post-illumination characteristics invariably present in each lamp (fluorescence characteristics or glowing behaviour of lamp filaments), the sum of all bright phases over the total revolution time amounts to about 50%. It is therefore unimportant whether the current pulses are all only in the positive direction (rippled direct current) or in the positive and negative direction, as in the case of the solid line V of the light cycle with 200 Hz. As already mentioned, the light maxima always occur in the region of the voltage or current maxima.

A light source is most suitably employed after the second solid line Z below the horizontal axis, the ripple of the said line fluctuating between 90 and 100% luminous intensity, so that the bright phases amount to 100%. A light source of this type is only surpassed by a direct current light source supplied by a smoothed or exact direct current.

Expediently, the ratio of the light frequency to the number of revolutions per unit time is an integral ratio, that is to say, for example, V:S=2:1, L:S=5:1 and Z:S=2:1. In this way, there are one or more, preferably two or more, in particular more than two, bright phases during the time of visibility of the image from a given observation position (this time corresponds to a half wave of the curves).

Design of the Apparatuses

The variant in FIG. 1 and 4 has a transparent drum 10 which possesses an upper and a lower end plate 19*c* and 19*b*, respectively. Two gas discharge lamps/PL lamps 3*b* are mounted in the lower plate 19*b*. In FIG. 4, it can be seen that the PL lamps 3*b* are fixed in their upper region to the upper plate 19*c*, through a guide 20. This serves to relieve the lower base (not shown in detail) of the lamps from the centrifugal force in the operating state. If desired, however, power connections may be provided on both plates 19*b*, 19*c*.

The lower plate 19*b* is mounted on a needle 21, and a tubular gear extension 23 is fastened to the plate 19*b*, concentrically with respect to the axis of rotation 22. On its outer side, this gear extension carries slip rings 24, with which carbon brushes 25 make contact. Only three slip rings 24 or carbon brushes 25 are shown, although different numbers of slip rings are required for different lamp designs. For example, a slip ring arrangement comprising six slip rings is required for a system with two PL tubes, whereas four slip rings are required for an arrangement comprising a single PL lamp and two slip rings are sufficient for an arrangement comprising an incandescent lamp.

Supply cables 26 lead from the carbon brushes 25 to alternating current voltage sources 5*b* and *c* according to FIG. 1 (the said sources may contain frequency amplifiers) or to a high-frequency ballast 7 according to FIG. 4. These components and a motor 27 are familiar to the skilled worker and therefore require no further description. The motor used is, for example, an asynchronous external rotor motor. The bearing needle 21, the carbon brushes 25, the alternating current voltage sources 5*b* and *c* and the high-frequency ballast 7 are fixed in an outer housing 28—in a manner which is not shown in detail. Like the image-carrying drum, the outer housing 28 is transparent and has a drum-like design and also possesses an upper and a lower end plate 29*a, b*. The end plates 19 and 29 are made, for example, of aluminium or of acrylic glass coloured so that it is opaque, while the cylindrical walls of the drum 10 or of the outer housing 28 are made of Plexiglas or glass.

The motor 27 drives the gear extension 23, and hence the drum 10, via a driving wheel 30. The slip rings 24 are connected to the gas discharge lamps 3*b* via current paths which are not shown, so that, when the power is switched on, these lamps light up and the motor 27 causes the drum 10 to rotate.

The image 14—shown only in FIGS. 2 and 5—is located in front of the gas discharge lamps 3*b* and is illuminated by these. The possible viewing angle is restricted to the image by the known grid (also not shown), with the result that the effect of all-around visibility is produced, as described in the Patent Applications cited at the outset.

The drum 10 or its upper end plate 19*c* is connected to the upper end plate 29*a* via a bearing and a bearing journal 31. The drum 10 is balanced in a manner which is not shown in detail but is familiar to the skilled worker, for example by applying balancing weights.

The other Figures are described in relation to one another. Identical parts bear identical reference numbers, while similar parts bear identical reference numbers and different indices. In FIG. 2, the drum 10 is shown in a position rotated through 90°, so that an image 14 with a lamellar grid 32 positioned in front is visible.

The light source 2*b* is located not inside the drum 10 but underneath it. It consists of three incandescent lamps 1*c, d, e*, which are held, about 120° apart, in the outer housing, which is not shown in FIG. 2.

The motor 27*a* is connected via a bearing shaft 8*d* directly to the lower end plate 19*a* which is transparent in the half in front of the grid 32 but darkened or provided with a reflective coating underneath.

Consequently, light passes from the incandescent lamps 1*c* to *e* through the end plate 19*a* onto or through the image 14. That space in the drum 10 which faces the image 14 is preferably provided with a reflective coating. The power supply to the incandescent lamps 1*c* to *e* is provided by alternating current voltage sources 5*b* to *d*, whose voltages are phase-shifted by 120° with respect to one another. This results in a substantially more uniform light from the light source 2*b* as a whole. With this voltage supply, the three lamps could, for example, also be accommodated inside the drum, with the result that the total time of the bright phases is at least 70% of the time per revolution.

A similar variant as in FIG. 2—shown with the light source 2*b* outside the drum 10—can be seen in FIG. 5. The gas discharge lamp 3*a* shown there is annular and is held around the axis of rotation 22, in the outer housing 28. The light rays are denoted by 33. The reflective coating of the space behind the image is indicated by shading.

The reflective coat of the end plate 19*a* in front of the grid 32 is denoted by 34. In contrast to the variants described above, the drum 10 is rotatably mounted underneath on a ball bearing 35 and at the top by means of needle bearing 36. This results in very quiet running and minimal hindrance of the light source 2*b* or of the light—indicated by the rays 33. The motor 27*b* is mounted transversely above the drum 10 on the baseplate 29*c* and drives the drum 10 by means of driving wheel 30*a*. By housing the motor 27*b* and the light source 2*b* in separate places, a mutual disadvantageous heat effect is eliminated. The transverse motor is furthermore flatter, so that the variant according to FIG. 5 is a relatively small unit, the image size being the same. The motor is kept pressed against the end plate 19*d* by a spring 37. The spring 37 is supported against a roof 38 of the outer housing 28.

The variant according to FIG. 6 shows a drum 10 having internally mounted light sources 2*a*, which consist of an incandescent lamp 1*a* or 1*b*. In this variant, the power is supplied not via slip rings but directly via the bearing shaft 8*b*, or via the bearing and the bearing journal 31*a*. Since the upper or lower end plate 19*c* or *b*, respectively, consists of conductive aluminium, the power supply to the lamps 1*a* or 1*b* can be tapped directly from these baseplates 19.

Alternatively to the power supply via the bearings or shafts 31*a* or 8*b*, respectively, it is also possible for carbon brushes to act directly on the end plates 19. The current paths inside the drum 10 are denoted by 26*a*. They are preferably very thin silver conductors which are adhesively bonded to the wall of the drum 10 and virtually undetectable with the unaided eye. However, rt is also possible to lay insulated wires in that part of the drum 10 which has a reflective coating. The power supply from the lower part of the means to the upper part is likewise via very thin conductors (not shown) on the outer housing, preferably on its inner side.

The motor 27*c* is cooled by providing a separate fan 39 which sucks in the air underneath and conveys it upwards between the drum 10 and the outer housing 28, with the result that the drum 10 too is cooled. Vents 16*a* allow the air to exit, while air inlet slots 11 permit entry. The power supplies to the fan 39 and to the motors are familiar to any skilled worker.

The variant according to FIG. 7 shows, instead of a separate fan, a fan wheel 12 mounted on an upper bearing shaft 8*e*. This fan wheel blows the exhaust air through the radial vents 16*b* to the outside. As in the lower region, the air is fed in through air inlet slots 11.

The drive used is a disc armature motor 27*d*. This is particularly flat and is therefore suitable for low apparatuses; it can also be flanged directly to the lower end plate. Rotary drive of the fan wheel 12 is provided via the drum 10. The radial vents 16*b* are provided in a tower-like attachment 39, which is mounted on the upper plate 29*d*.

FIG. 3 shows a section through a fluorescent tube 3*c* having a particular fluorescent layer 6 which has particularly long-lasting afterglow behaviour and hence results in particularly long bright phases.

The invention covers a large number of possible modifications; for example, stroboscope lamps connected in the manner described can be used as the light source. In this case, the number of light flashes can be synchronised via contact discs or the like (cf. cylinder 23) or by means of electronic synchronisation of the rotary speed.

List of Reference Symbols

| List of reference symbols: | |
|---|---|
| 1a, b, c, d | Incandescent lamp |
| 2a, b | Light source |
| 3a, b, c | Gas discharge lamp |
| 4 | Direct current or alternating current voltage source |
| 5a, b–d, e | Alternating current source |
| 6 | Fluorescent layer |
| 7 | High-frequency ballast |
| 8a, b, c, d, e | Bearing shaft |
| 9 | Rotary bearing |
| 10 | Image-carrying drum |
| 11a | Air inlet slot |
| 12 | Fan wheel |
| 13 | Motor |
| 14 | Image |
| 15 | Power supply |
| 16 | Vents |
| 18 | Axis of rotation |
| 19a, b, c | End plate of the image-carrying drum |
| 20 | Guide |
| 21 | Bearing needle |
| 22 | Axis of rotation |
| 23 | Gear extension |
| 24 | Slip rings |

-continued

| List of reference symbols: | |
|---|---|
| 25 | Carbon brushes |
| 26a | Supply cables |
| 27a, b, c, d | Motor |
| 28 | Outer housing |
| 29a, b, c, d | End plate of the housing 28 |
| 30a | Driving wheel |
| 31a | Bearing and bearing journal |
| 32 | Grid |

What is claimed is:

1. Display means for all-around illuminated display of a flat image over an angle of 360 degrees, having:

a light source adapted to emit a luminous flux, a drive motor and an image carrier capable of being driven by said motor, said image carrier displaying at least one image arranged to be illuminated by said light source, and capable of being rotated at a minimum rotary speed of 500 rpm, whereby the ratio of bright phases of said luminous flux, with brightness exceeding 50% of maximum luminous intensity, to rotary speed of said image carrier is selected in such a way that any remaining fluctuation in brightness is undetectable by human visual apparatus.

2. Display means according to claim 1, wherein during each complete revolution of said image carrier through 360 degrees, the total time of all bright phases amounts to at least 30% of a revolution time of said image carrier.

3. Display means according to claim 1, wherein each dark phase lasts no longer than 0.0025 second.

4. Display means according to claim 2, wherein each dark phase lasts no longer than 0.0025 second.

5. Light source according to claim 1, wherein said light source comprises at least one incandescent lamp which is adapted to be supplied with direct current.

6. Display means according to claim 1, wherein said light source comprises a gas discharge lamp, an alternating current voltage of at least 300 Hz being provided as the supply voltage.

7. Display means according to claim 6, whereby said alternating current voltage is of up to 40,000 Hz.

8. Display means according to claim 1, wherein said light source comprises a gas discharge lamp with a fluorescent layer for afterglow.

9. Light source according to claim 6, wherein said light source comprises a gas discharge lamp with a fluorescent layer for afterglow.

10. Display means according to claim 1, wherein said light source comprises at least two lamps, said lamps being capable of being supplied with voltage phase-shifted by at least 120 degrees.

11. Display means according to claim 10, wherein two lamps are provided and said voltage phase-shift is 180 degrees.

12. Display means according to claim 1, wherein said image-carrier comprises a transparent, rotatable drum with an image mounted at its axis of rotation, and said light source is rotationally symmetrical to said axis of rotation of said image-carrying drum, outside said drum, and an image carrier baseplate on said drum faces said light source and is at least partially transparent for illumination of the image with reflected or transmitted light, the image carrier preferably being in the form of a transparent drum with a image mounted in the axis.

13. Display means according to claim 1, wherein said light source comprises at least one lamp mounted eccentrically in front of an image in a plate of a rotatable, transparent drum which forms said image carrier, said lamp being held in an opposite plate of said drum.

14. Display means according to claim 1, wherein voltage is supplied to said light source via rotary bearings, said voltage being selected so that required current does not exceed 1 amp.

15. Display means according to claim 1, wherein said image-carrier comprises a drum and means provide forced ventilation which directly cools a lamp located outside said drum.

16. Display means according to claim 1, wherein said image carrier is a drum with an image within said drum, said drum being adapted to convey cool air from a lower region of said display means upwards between a transparent outer housing and said drum.

17. Display means according to claim 16, whereby vents are provided in upper and lower regions of said drum.

18. Display means according to claim 16, whereby a fan wheel is fastened to said drum.

19. Display means according to claim 2, wherein during each complete revolution of said image carrier through 360 degrees, the total time of all bright phases amounts to at least 50% of said time of a revolution of said image carrier.

20. Display means according to claim 19, wherein during each complete revolution of said image carrier through 360 degrees, the total time of all bright phases amounts to at least 70% of said time of a revolution of said image carrier.

21. Display means according to claim 1, wherein during each complete revolution of said image carrier through 360 degrees, the frequency of a light cycle is at least 200 Hz, said bright phases emitting at least 75% of maximum luminous intensity.

22. Display means according to claim 21, wherein said bright phases emit at least 90% of maximum luminous intensity.

23. Display means according to claim 1, wherein the ratio of said bright phases to rotary speed is selected in such a way that the time of visibility of said image from a given observation point corresponds to at least one bright phase and said ratio is an integral ratio.

24. Display means according to claim 23, wherein said time of visibility of said image from a given observation point corresponds to at least two bright phases.

25. Display means according to claim 2, wherein the ratio of said bright phases to rotary speed is selected in such a way that the time of visibility of said image from a given observation point corresponds to at least one bright phase and said ratio is an integral ratio.

26. Display means according to claim 25, wherein said time of visibility of said image from a given observation point corresponds to at least two bright phases.

27. Display means according to claim 26, wherein said time of visibility of said image from a given observation point corresponds to more than two bright phases.

28. Display means according to claim 1, wherein said light source comprises at least one incandescent lamp adapted to be supplied with an alternating current of at least 100 Hz.

29. Display means according to claim 1, wherein said image carrier is in the form of a transparent drum with an image mounted at its axis.

30. Display means according to claim 6, wherein afterglow time of said layer with at least 90% of the maximum light intensity is longer than 1/500 second.

31. Display means according to claim 1, wherein said power source comprises at least one lamp mounted eccentrically in front of the image in a plate of a rotatable, transparent drum which forms said image carrier, a power supply for said lamp being arranged at a top and at a bottom of said drum via a bearing shaft.

* * * * *